US008084677B2

(12) United States Patent
Wilder

(10) Patent No.: US 8,084,677 B2
(45) Date of Patent: Dec. 27, 2011

(54) SYSTEM AND METHOD FOR ADAPTIVE MELODIC SEGMENTATION AND MOTIVIC IDENTIFICATION

(75) Inventor: Gregory Winston Wilder, Philadelphia, PA (US)

(73) Assignee: Orpheus Media Research, LLC, Brooklyn, NY (US)

( * ) Notice: Subject to any disclaimer, the term of this patent is extended or adjusted under 35 U.S.C. 154(b) by 0 days.

(21) Appl. No.: 12/777,448

(22) Filed: May 11, 2010

(65) Prior Publication Data

US 2010/0251876 A1 Oct. 7, 2010

Related U.S. Application Data

(63) Continuation of application No. PCT/US2007/089225, filed on Dec. 31, 2007.

(51) Int. Cl.
*A63H 5/00* (2006.01)
*G04B 13/00* (2006.01)
*G10H 7/00* (2006.01)

(52) U.S. Cl. ..... 84/609

(58) Field of Classification Search ..... 84/609, 84/634

See application file for complete search history.

(56) References Cited

U.S. PATENT DOCUMENTS

| | | | | |
|---|---|---|---|---|
| 5,182,414 | A * | 1/1993 | Takahashi | 84/634 |
| 6,225,546 | B1 * | 5/2001 | Kraft et al. | 84/609 |
| 6,395,970 | B2 * | 5/2002 | Aoki | 84/613 |
| 6,574,594 | B2 | 6/2003 | Pitman et al. | |
| 6,747,201 | B2 * | 6/2004 | Birmingham et al. | 84/609 |
| 7,206,775 | B2 | 4/2007 | Kaiser et al. | |
| 7,227,072 | B1 | 6/2007 | Weare | |
| 7,772,478 | B2 * | 8/2010 | Whitman et al. | 84/609 |
| 2003/0089216 | A1 * | 5/2003 | Birmingham et al. | 84/609 |
| 2004/0060424 | A1 * | 4/2004 | Klefenz et al. | 84/616 |
| 2004/0200335 | A1 * | 10/2004 | Phillips | 84/483.2 |
| 2006/0190450 | A1 | 8/2006 | Holm et al. | |
| 2006/0288849 | A1 * | 12/2006 | Peeters | 84/616 |
| 2007/0113724 | A1 | 5/2007 | Kim et al. | |
| 2007/0131094 | A1 * | 6/2007 | Kemp | 84/609 |

OTHER PUBLICATIONS

T. Weyde, Integrating Segmentation and Similarity in Melodic Analysis, Proceedings of the International Conference on Music Perception and Cognition 2002, pp. 240-243, Sydney, Australia, University of New South Wales, Retrieved on Apr. 29, 2008, www.sci.city.ac.uk.

M. Wattengerg, Arc Diagrams: Visualizing Structure in Strings, IBM Research, IEEE Symposium on Information Visualization, 2002, 8 pgs., InfoVis 2002.

T. Weyde, Integrating Segmentation and Similarity in Melodic Analysis, ISE 599, 2004, 3 pgs, 11 slides, Presented by B. Harlan.

M. Hamanaka, K. Hirata, S. Tojo, Atta: Automatic Time-Span Tree Analyzer Based on Extended GTTM, 2005, pp. 358-365, Queen Mary, University of London.

* cited by examiner

*Primary Examiner* — Jeffrey Donels

(74) *Attorney, Agent, or Firm* — Downs Rachin Martin PLLC; Peter S. Weissman

(57) ABSTRACT

The present invention comprises a system and method, modeled on research observations in human perception and cognition, capable of accurately segmenting primarily (although not exclusively) melodic input in performance data and encoded digital audio data, and mining the results for defining motives within the input data.

18 Claims, 2 Drawing Sheets

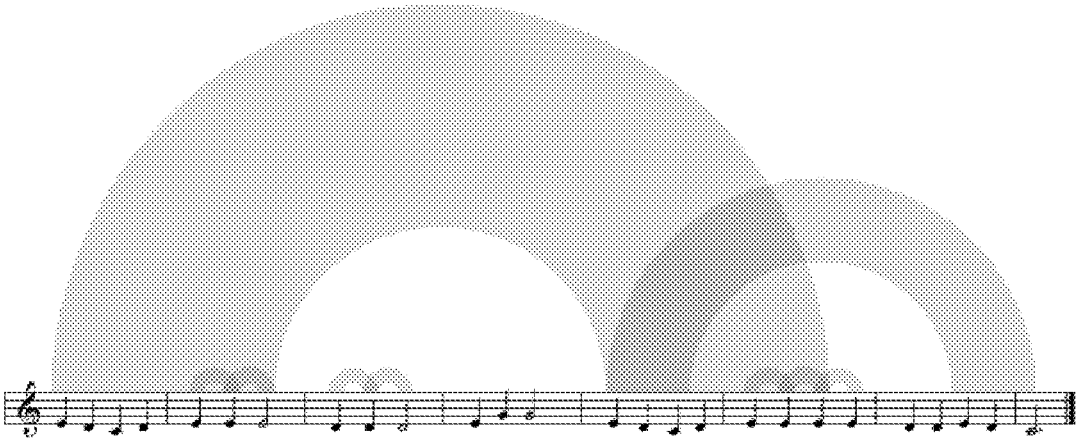
PRIOR ART Fig. 1 – Musical Form of "Mary Had a Little Lamb"
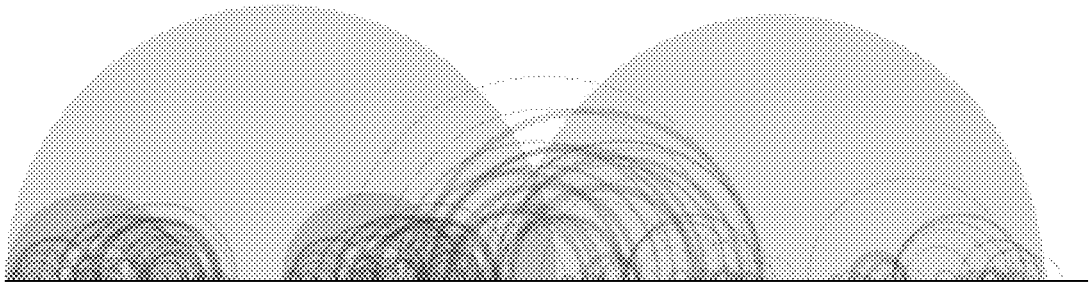
PRIOR ART Fig. 2 – Musical Form of J.S. Bach, "Minuet in G Major"

SYSTEM AND METHOD FOR ADAPTIVE MELODIC SEGMENTATION AND MOTIVIC IDENTIFICATION

RELATED APPLICATION

This is a continuation of PCT/US2007/089225 (WO 2009/085054) filed Dec. 31, 2007, the contents of which is hereby incorporated in its entirety by reference.

SUMMARY OF THE INVENTION

The present invention is a computer-implemented method and system for the analysis of musical information. Music is an informational form comprised of acoustic energy (sound) or informational representations of sound (such as musical notation or MIDI datastream) that conveys characteristics such as pitch (including melody and harmony), rhythm (and its characteristics such as tempo, meter, and articulation), dynamics (a characteristic of amplitude and perceptual loudness), structure, and the sonic qualities of timbre and texture. Musical compositions are purposeful arrangements of musical elements. Because music may be highly complex, varying over time in many simultaneous dimensions, there exists a need to characterize musical information so that it may be indexed, retrieved, compared, and otherwise automatically processed. The present invention provides a system and method for doing-so that considers the perceptual impact of music on a human listener, as well as the objective physical characteristics of musical compositions.

The present invention comprises methods, modeled on research observations in human perception and cognition, capable of accurately segmenting primarily (although not exclusively) melodic input and mining the results for defining motives using context-aware search strategies. These results may then be employed to describe fundamental structures and unique identity characteristics of any musical input, regardless of style or genre.

BACKGROUND OF THE INVENTION

Musical melodies consist, at the least, of hierarchal grouped patterns of changing pitches and durations. Because music is an abstract language, parsing its grammatical constructs require the application of expanded semiotic and Gestalt principals. In particular, the algorithmic discretization of musical data is necessary for successful automated analysis and forms the basis for the present invention.

Melodic Construction and Analysis

Term Definitions

Phrase: a section of music that is relatively self contained and coherent over a medium time scale. A rough analogy between musical phrases and the linguistic phrase can be made, comparing the lowest phrase level to clauses and the highest to a complete sentence.

Melody: a series of linear musical events in succession that can be perceived as a single (Gestalt) entity. Most specifically this includes patterns of changing pitches and durations, while most generally it includes any interacting patterns of changing events or quality. Melodies often consist of one or more musical phrases or motives, and are usually repeated throughout a work in various forms.

Prototypical Melody: generalization to which elements of information represented in the actual melody may be perceived as relevant.

Motive: the smallest identifiable musical element (melodic, harmonic, or rhythmic) characteristic of a composition. A motive may be of any size, though it is most commonly regarded as the shortest subdivision of a theme or phrase that maintains a discrete identity. For example, consider Beethoven's Fifth Symphony (Opus 67 in C minor, first movement) in which the pattern of three short notes followed by one long note is present throughout.

Musical Hierarchies

Consider the graphic representation of musical form using the first line of Mary Had a Little Lamb shown in FIG. 1. The arcs connect two passages that contain the same sequence of notes. (after, Martin Wattenberg, "Arc Diagrams: Visualizing Structure in Strings," infovis, p. 110, 2002 IEEE Symposium on Information Visualization (InfoVis 2002), 2002.) Using this technique to graphically represent J. S. Bach's Minuet in G Major, shown in FIG. 2, a more elaborate (and potentially more interesting) series of hierarchical patterns emerges. (Wattenberg, 2002)

The internal structure of musical compositions is understood hierarchically; phrases often contain melodies, which are in turn composed of one or more motives. Phrases may also combine to form periods in addition to larger sections of music. Each hierarchical level provides essential information during analysis; smaller units tend to convey composition-specific identity characteristics while the formal design of larger sections allow general classification based on style and genre.

During the 1960s, composer and theorist Edward Cone devised the concept of hypermeter, a large scale metric structure consisting of hypermeasures and hyperbeats. Hyperunits describe patterns of strong and weak emphasis not notated in the musical score, but that are perceived by listeners and performers as "extended" levels of hierarchical formal organization. (Krebs, Harald (2005). "Hypermeter and Hypermetric Irregularity in the Songs of Josephine Lang.", in Deborah Stein (ed.): Engaging Music: Essays in Music Analysis. New York: Oxford University Press.)

Further hierarchical approaches to musical analysis were introduced by theorist Heinrich Schenker in the 1930s, and later expanded by Salzer, Schachter. and others. By the 1980s, these views formed the foundation of "Schenkerian Analysis Techniques" and is one of the primary analytical methods practiced by music theorists today.

Semiotic and Cognitive Considerations

Music Semiology

With the exception of certain codes (rule-driven semiotic systems which suggest a choice of signifiers and their collocation to transmit intended meanings), music is an abstracted language that lacks specific instances and definitions with which to communicate concrete ideas. Because musical information is encoded in varying modalities (e.g. written and aural), the understanding of its defining grammatical principles is best illuminated through the study of music semiology, a branch of semiotics developed by musicologists Nattiez, Hatten, Monelle, and others.

Composer/musicologist Fred Lerdahl and linguist Ray Jackendoff have attempted to codify the cognitive structures (or "mental representations") a listener develops in order to acquire the musical grammar necessary to understand a particular musical idiom, and also to identify areas of human musical capacity that are limited by our general cognitive functions. These investigations led the authors to conclude that musical discretization, or segmentation, is necessary for cognitive perception and understanding, thus making discretization the basis for their work on pitch space analysis and cognitive constraints in human processing of musical grammar. (Lerdhal, F., Jackendoff, R. A *Generative Theory of Tonal Music*. MIT Press, Cambridge, Mass. (1983); Jackendoff, R.& Lerdahl, F., "The Human Music Capacity: What is it and what's special about it?," Cognition, 100, 3372 (2006).) For these reasons, the process of musical analysis often involves reducing a piece to relatively simpler and smaller parts. This process of discretization is generally considered necessary for music to become accessible to analysis. (Nattiez, JeanJacques. *Music and Discourse: Toward a Semiology of Music*. (Musicologie générale et sémiologue, 1987). Translated by Carolyn Abbate (1990).)

Gestalt and the Implication Realization

Cognition Model

The founding principles of Gestalt perception suggest that humans tend to mentally arrange experiences in a manner that is regular, orderly, symmetric, and simple. Cognitive psychologists have defined "Gestalt Laws" which allow us to predict the interpretation of sensation. Of particular interest to musical cognition research is the Law of Closure, which states that the mind may experience elements it does not directly perceive in order to complete an expected figure.

Eugene Narmour's *Implication-Realization Model* (Narmour, E. *The Analysis and Cognition of Basic Melodic Structures: The Implication-Realization Model*. Chicago: University of Chicago Press. (1990); Narmour, E. *The Analysis and Cognition of Melodic Complexity The Implication-Realization Model*. Chicago: University of Chicago Press. (1992)) is a detailed formalization based on Leonard Meyer's work on applied Gestalt psychology principles with regard to musical expectation.

(Meyer, Leonard B. *Emotion and Meaning in Music*. Chicago: Chicago University Press. (1956)) This theory focuses on implicative intervals that set up expectations for certain realizations to follow. Narmour's model is one of the most significant modern theories of melodic expectation, providing specific detail regarding the expectations created by various melodic structures.

*Analysis and Cognition of Basic Melodic Structures: The Implication Realization Model* begins with two general claims. The first is given by "two universal formal hypotheses" describing what listeners expect. The process of melody perception is based on "the realization or denial" of these hypotheses (1990):

1) A+A→A (hearing two similar items yields an expectation of repetition)

2) A+B→C (hearing two different items yields an expected change)

The second claim is that the "forms" above function to provide either closure or nonclosure. Narmour goes on to describe five melodic archetypes in accordance with his theory:

1) process [P] or iteration (duplication) [D] (A+A without closure)

2) reversal [R] (A+B with closure)

3) registral return [A+B+A] (exact or nearly exact return to same pitch)

4) dyad (two implicative items, as in 1 and 2, without a realization)

5) monad (one element which does not yield an implication)

Central to the discussion is direction of melodic motion and size of intervals between pairs of pitches. [P] refers to motion in the same registral direction combined with similar intervallic motion (two small intervals or two large intervals). [D] refers to identical intervallic motion with lateral registral direction. [R] refers to changing intervallic motion (large to relatively smaller) with different registral directions.

P, D, and R only account for cases where registral direction and intervallic motion are working in unison to satisfy the implications. When one of these two factors is denied, there are more possibilities; the five archetypal derivatives:

1) intervallic process [IP]: small interval to similar small interval, different registral directions 2) registral process [VP]: small to large interval, same registral direction 3) intervallic reversal [IR]: large interval to small interval, same registral direction 4) registral reversal [VR]: large interval to larger interval, different registral direction 5) intervallic duplication [ID]: small interval to identical small interval, different registral directions Narmour contends that these eight symbols reference either a "prospective" or "retrospective" dimension and are therefore representative of generally available cognitive musical structures: "As symbological tokens, all sixteen prospective and retrospective letters purport to represent the listener's encoding of many of the basic structures of melody." (1990)

Data Representation

The difficulties in accurately representing music for transmission and analysis have plagued musicians since sounds were first notated. Musical representation differs from generalized linguistic techniques in that it involves a unique combination of features among human activities: a strict and continuous time constraint on an output that is generated by a continuous stream of coded instructions. Additionally, it remains difficult (even for human experts) to consistently determine which musical elements are most important when transcribing musical performances. Past approaches have tended to favor perceived "foreground" parameters which are easiest to notate, while neglecting similarly important aspects of musical expression that are more difficult to capture or define. These challenges require a multidimensional representation system capable of measuring the amount of raw and relative change in simultaneous attribute dimensions and signifiers.

Pattern Variation and Relevance

Once an adequate method of data collection and representation has been implemented, it remains problematic to reliably discover and compare potentially related musical ideas due to their various presentations and functions within a given work. Past models have attempted to directly extract significant patterns from raw musical material only to be overwhelmed with the volume of results, most of which may be unimportant. Flexible, context-based judgments are required to determine the prototypical structure and the analytical relevance of musical ideas, a task not well suited to standard heuristic techniques.

Semantic Interpretation Issues

While the encoding of music shares certain characteristics with linguistic and grammar studies, research clearly demonstrates that many aspects of human musical capacity are interlinked with other more general cognitive functions. This observation, along with the semiotic nature of musical languages, requires a system capable of rendering adaptive solutions to largely self-defined data sets.

Idiomatic Relational Grammar

A generative grammar is a set of rules or principles that recursively "specify" or "generate" the well-formed expressions of a natural language. Semiotic codes create a transformational grammar that renders rule-based approaches very weak. Even if idiomatic grammar rules could be found to provide a robust approach to musical data mining and analysis, it remains that individual pieces of music are fundamentally created from (and therefore shaped by) unique motivic ideas. This observation leads to the debate surrounding the definition of creativity and its origins.

Data Mining within Creative Models

Creativity has been defined as "the initialization of connections between two or more multifaceted things, ideas, or phenomena hitherto not otherwise considered actively connected." (Cope, David. *Computer Models of Musical Creativity*. Cambridge, Mass.: MIT Press, 2005.) These inconspicuous and generally unpredictable connections create data characteristics that are often responsible for the most interesting (and arguably influential) musical works. Effectively interpreting this broad landscape requires any analyst (human or otherwise) to draw on contextual experience while maintaining a flexible approach.

Prior Art Approaches to Algorithmic Musical Data Mining

Musical analysis generally involves reducing a piece to relatively smaller and simpler parts. This process of discretization, or segmentation, is necessary for the implementation of an algorithmic approach to significant pattern discovery.

Melodic Segmentation

Prior art approaches have tended toward the application of complicated rule sets that rely on assumptions about specific style and language conventions.

Overall, these approaches demonstrate four points of failure:

1) Rule based segmentation tends to create internal conflicts in real world application scenarios. Dependable musical analysis requires the awareness of contextual data trends when making segmentation boundary decisions.
2) Even if these conflicts are resolved appropriately, the assumptions required to design the original rule base necessarily limit the analysis process with regard to style and genre.
3) Certain implementations of rule based discretization systems require preprocessing of the input data to provide consistency within the samples. While this may make data processing more straightforward, it alters the original input, thus destroying the integrity of the data, making the results unreliable.
4) Grammatical rules may be useful in describing detailed analysis observations and outlining stylistic conventions, but these rules on their own do not provide the necessary knowledge base required to recreate an example resembling the original subject. This strongly suggests that no matter how complex a system of strict rules may become, it cannot adequately describe the transformational grammar at work in musical contexts. (By way of example: undergraduate music theory students are often taught part writing and counterpoint using rules drawn from "expert" analysis and observation, however they are rarely able to produce results that rival the models upon which these rules are based.)

Gestalt Segmentation (Tenney, J., Polansky, L., "Temporal Gestalt Perception," Music Journal of Music Theory," Vol. 24, Issue 2, 1980. (pp. 205-241))

This prior art method relies on a single change indicator that presumes the inverse of proximity and similarity upon which grouping preference rule systems are based. When elements exceed a certain threshold of total (Gestalt) change, a boundary is formed. While correct in predicting the application of Gestalt principals, this system remains inflexible in that it relies on a single indicator of change and a predetermined threshold value.

GTTM Grouping Preference Rules (Lerdahl and Jackendoff, 1983)

Musician Fred Lerdahl and linguist Ray Jackendoff attempted to codify the cognitive structures (or "mental representations") a listener develops in order to acquire the musical grammar necessary to understand a particular musical idiom.

1) GPR 1 (size) Avoid small grouping segments. The smaller, the less preferable.
2) GPR 2 (proximity) Given n1, n2, n3, n4; n2n3 may be group boundary if:
   1. attack point interval between n2n3>n1n2 && n3n4 OR
   2. time between end of n2 and attack point of n3>end of n3 to attack point of n4.
3) GPR 3 (change) Given n1, n2, n3, n4; n2n3 may be group boundary if:
   1. pitch interval between n2n3>n1n2&& n3n4 OR
   2. dynamic interval of change between n2n3>n1n2&& n3n4 OR
   3. articulation duration between n2n3>n1n2&& n3n4 OR
   4. length of n2 !=n3 && length of (n1+n2)=(n3+n4)
4) GPR 4 (intensification) When groupings from GPR 2&3 become pronounced, they may be split into higher level groups.
5) GPR 5 (symmetry) Grouping two parts of equal length.
6) GPR 6 (parallelism) Similar segments are preferably seen as parallel.
7) GPR 7 (timespan and prolongation stability) Large scale groupings that allow the greatest stability of the groupings within it.

While they provide a valuable guide for the application of Gestalt principals and music cognition research to melodic segmentation, algorithmic implementations of the GPRs routinely lead to internal rule conflicts.

Structure Grouping (Berry, Wallace. *Structural Functions in Music*. New York: Dover Publications. 1987; and Cambouropoulos, E. (1997). Musical Rhythm: A Formal Model for Determining Local Boundaries, Accents and Meter in a Melodic Surface. in M. Leman (Ed.), Music, Gestalt, and Computing: Studies in Cognitive and Systematic Musicology (pp. 277-293). Berlin: Springer-Verlag.)

This technique is an extension of Gestalt Segmentation based on Lerdahl and Jackendoff's GPR 3 and Tenny and Polansky's research, that applies a preestablished threshold to the following criteria: tempo, register shift (pitch), approach (pitch), duration, articulation, timbre, and texture density. Recognizing the need to employ threshold tests to multiple attributes is an improvement on previous designs; however, this system remains insensitive to data tendencies and is therefore successful in only a limited number of cases.

The Cognition of Basic Musical Structures (Temperley, David. *The Cognition of Basic Musical Structures*. Cambridge, Mass.: MIT Press. 2001)

This theory consists of six preference rule systems (conceptually similar to the GTTM), each containing "well-formedness" rules that define a class of structural descriptions that specify an optimal application for the given input. The six grammatical attributes analyzed are: meter, phrasing, counterpoint, harmony, key and pitch. Temperley's approach requires event onset quantization (based on an arbitrary 35 ms threshold) which alters (and therefore destroys) the integrity of the input data. In addition, algorithmic implementation of several of the proposed rule systems is impossible due to the fact that the descriptions are inadequate or incomplete. By way of example: phrase structure preference rule (PSPR) 2 claims that ideal melodic phrases should contain approximately 8 note events, which is an unjustified assumption based on one specific musical style.

Automatic Generation of Grouping Structure (Hamanaka, M., Hirata, K. & Tojo, S., "ATTA: Automatic Time-Span Tree Analyzer Based on Extended GTTM", in Proceedings of the Sixth International Conference on Music Information Retrieval, ISMIR 2005, 358-365.)

As previously discussed, direct application of the GTTM suffers from frequent rule conflicts. The authors of this study introduced adjustable parameters, in addition to a basic weighting process that allows for priority among the GPR. Recognizing the faults of the inflexible rule-based GPR algorithms is a step in the right direction, however, this attempt fails to include procedures that allow for continuous context-based parameter adjustment; changes are made at the beginning of the process, but the parameters fail to fully adapt and comply to the input data. The result is clearly an improvement on the GTTM, but remains inflexible nonetheless.

Pattern Analysis in Music Data

Most historical approaches have attempted to mine musical patterns from low-dimension string representations; often without any preprocessing whatsoever. This has resulted in one of three common points of failure:

1) Applying heuristic search techniques to strings of musical data produces an overwhelming number of results; most of which are unimportant in terms of cognitive perception. Musical grammar naturally contains similar patterns throughout, but determining which of these have analytical value remains a significant challenge.
2) Some approaches attempt to filter results based on pattern frequency or length, however this still ignores the greater context considerations described within the largely self-defined musical data set.
3) In nearly every case, the difficulty of identifying musical parallelism remains unaddressed. Empirical research (Deliège, I., "Prototype effects in music listening: An empirical approach to the notion of imprint," Music Perception, 18, 2001. (pp. 371-407)) strongly suggests that beginnings of patterns play a crucial role in cognitive pattern recognition. This requires either preprocessing segmentation or a post-processing filtering algorithm capable of reliably identifying pattern start points so that beginning similarity can be analyzed.

Interactive Music Systems: Machine listening and Composing (Rowe, Robert. Interactive music systems: Machine listening and composing. Cambridge, Mass.: MIT Press. 1993.)

Rowe's approach rates each pattern occurrence based on the frequency with which the pattern is encountered. While frequency of pattern occurrence is an important factor in determining pattern relevance, this system ignores contextual issues and phrase parallelism (GPR 6).

Music Indexing with Extracted Melody (Shih, H. H., S. S. Narayanan, and C. C. Jay Kuo, "Automatic Main Melody Extraction from MIDI Files with a Modified LempelZiv Algorithm," Proc. of Intl. Symposium on Intelligent Multimedia, Video and Speech Processing, 2001.)

The disclosed method is a dictionary approach to repetitive melodic pattern extraction. Segmentation is based solely on tempo, meter, and bar divisions read from score. After basic extraction using a modified Lempel Ziv 78 compression method, the data is pruned to remove non-repeating patterns. Search and pruning processes are repeated until dictionary converges. Relying on the metric placement of musical events to determine hierarchal relevance can be misleading—this is especially true for complex music and most "Classical" literature composed after 1800. While this approach may work with some examples, musical phrasing often functions "outside" the bar.

FlExPat: Flexible Extraction of Sequential Patterns (Rolland, PierreYves, "Discovering patterns in musical sequences," Journal of New Music Research, 1999. (pp. 334-350); Rolland, PierreYves, "FlExPat: Flexible extraction of sequential patterns," Proceedings of the IEEE International Conference on Data Mining (IEEE ICDM'01). (pp. 481-488) San Jose, Calif. 2001.)

This method identifies all melodic passage pairs that are significantly similar (based on a similarity threshold set in advance), extracts the patterns, and orders them according to frequency of occurrence and pattern length. The heavy combinatorial computation required is carried out using dynamic programming concepts. The use of euclidean distance-based dynamic programming techniques is an important advance toward increasing computational efficiency; however, this approach generates many unimportant results and does not take into account contextual issues and the importance of phrase parallelism (GPR 6).

Finding Approximate Repeating Patterns from Sequence Data (J. L. Hsu, C. C. Liu, and Arbee L. P. Chen, "Discovering Nontrivial Repeating Patterns in Music Data," Proceedings of IEEE Transactions on Multimedia, pp: 311-325, 2001.)

This method is an application of feature extraction from music data to search for approximate repeating patterns. "Cut" and "Pattern Join" operators are applied to assist in sequential data search. This approach fails to introduce continuity issues raised through examination of midlevel and global context trends. Musical Parallelism and Melodic Segmentation: A Computational Approach (Cambouropoulos, E., "Musical Parallelism and Melodic Segmentation: A Computational Approach." Music Perception 23(3):249-269. (2006))

According to this method, discovered patterns are used as a means to determine probable segmentation points of a given melody. Relevant patterns are defined in terms of frequency of occurrence and length of pattern. The special status of non-overlapping, immediately repeating patterns is examined. All patterns merge into a single "pattern" segmentation profile that signifies points within the surface most likely to be perceived as segment boundaries. Requiring discovered patterns to be non-overlapping allows Cambouropoulos to introduce elements of context consideration into his process. However, by attempting to produce segmentation results using initial pattern searches, the process runs contrary to firmly established understandings of music cognition: namely the need for surface discretization for music to become accessible to algorithmic analysis. (Nattiez 1990)

In the patent literature, U.S. Pat. No. 6,747,201 to Birmingham, et al. teaches a method using an exhaustive search for all potential patterns in a musical work, which are then filtered and rated by perceptual significance. U.S. Pat. No. 7,227,072 to Weare discloses a system and method for processing audio recordings to determine similarity between audio data sets. Component such as harmonic, rhythmic and melodic input are generated and arbitrarily reduced in dimensionality to six by a mapper using two-dimensional feature maps generated by a trainer. The method disclosed produces results completely different from a melodic segmentation approach which requires the separation of polyphonic input into monophonic lines in order to develop a catalog of relational change (delta) between individual attributes (pitch, rhythm, articulation, dynamics) of individual musical events. Moreover, without knowing the full data set used by the trainer, however, the method cannot be defined, and its results cannot be repeated. Finally, U.S. Pat. No. 7,206,775 to Kaiser, et al. discloses a music playlist generator based on genre "classification" (both human and automated) of media. No classification method is disclosed, and the patent teaches that there are no automated processes known that are capable of producing adequate results without human intervention in the processing method.

BRIEF DESCRIPTION OF THE DRAWINGS

FIG. 1 is a prior art musical form of "Mary Had a Little Lamb";

FIG. 2 is a prior art musical form of J. S. Bach, "Minuet in G Major"; and

DETAILED DESCRIPTION OF THE INVENTION

Data Formatting and Representation

Figure 3:
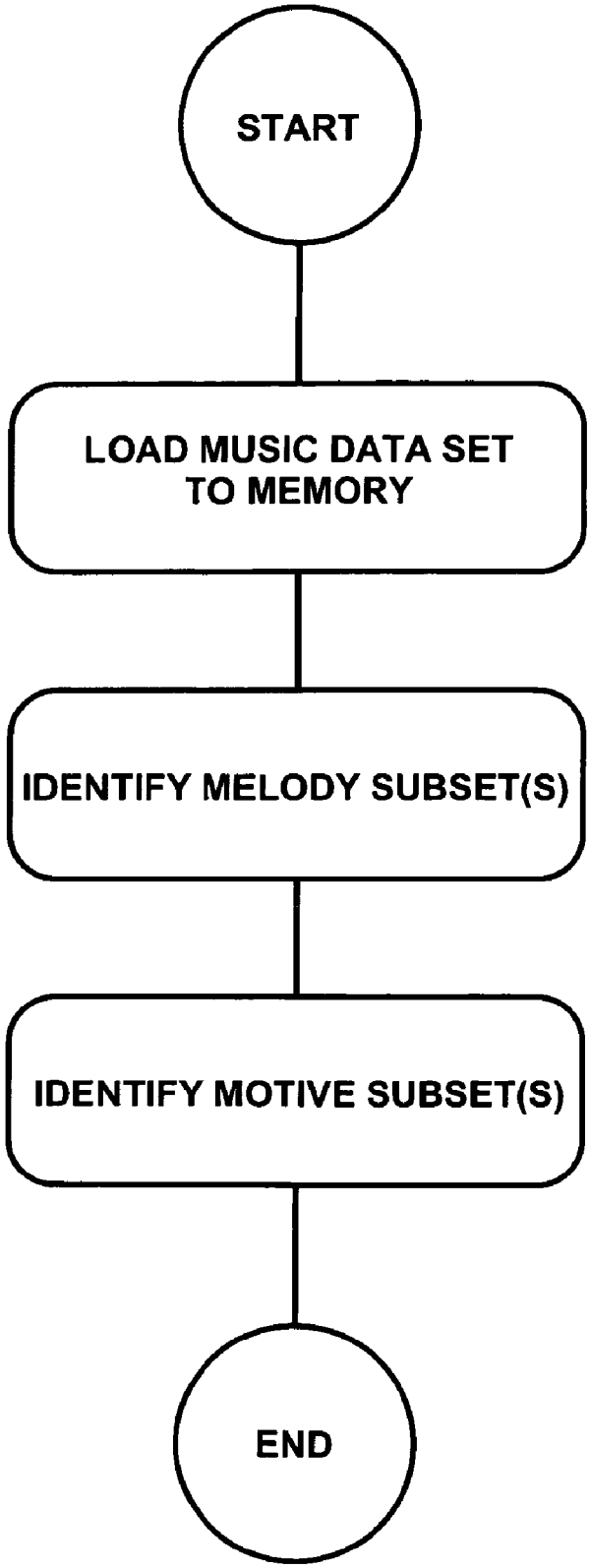
FIG. 3 is a flow diagram of the method of the present invention.

Musical data is represented indirectly within the system of the present invention as a series of note event attribute changes. Both manual (performance data such as MIDI or score and the like) and auditory (encoded audio in the form of AIF, FLAC, MP3, MP4, and the like) input streams are used to build a comprehensive picture of the data models. Manual input supplies detailed information while auditory streams provide a simulation of the actual human listening experience. A user determined "style tag" may optionally be provided along with the model data for purposes of categorization and software training. This approach is based on current cognition models and is similar to the way humans acquire and process novel information. In this manner, associated identifiers and style awareness are developed over time and exposure to data streams.

Manual (MIDI/SCORE) Models

Working with MIDI and score data allows in the present invention permits:

1) the high level of precision necessary for detailed analysis,
2) instrument-specific controller information, and
3) the ability compare specific performance data with perceived auditory data.

Global MetaStructure

According to the present invention, the data provided comprises: phrase structure, measure and tempo information, section identifiers, stylistic attributes, exact pitch, onset, offset, velocity, as well as note density for both micro (measure) and macro (phrase/section) groupings. Tracking includes translating controller data into stylistically context aware performance attributes.

Stylistic Performance Implications

By further comparing the analysis output with the calculated tempo grid, a specific analysis of stylistic character can occur. The exacting nature of this data format makes it especially (although not exclusively) suited to the segmentation analysis techniques described herein.

Auditory Models

Working directly with auditory input allows the present invention to provide:

1) the modeling of human perception enhancements (and limitations),
2) realistic analysis of polyphonic textures (i.e. alberti bass),
3) and the potential to detect subtle performance variations (timbre, tempo).

The following is a list of core issues along with their respective solutions specific to auditory model processing in the present invention.

Equal Loudness (Fletcher-Munson) Contour Filtering

Human aural sensitivity varies with frequency. Software listeners filter input to compensate for this natural phenomenon and ensure relevant model analysis. First documented by Fletcher and Munson in 1933 (and refined by Robinson and Dadson in 1956), an equal loudness contour is the measure of sound pressure, over the frequency spectrum, for which a listener perceives a constant loudness. Aspects of implementing this filtering process have been described by Berry Vercoe (MIT), David Robinson and others.

Frequency Tracking

The present invention employs spectral pitch tracking process using Csound's PVSPITCH opcode (Alan Ocinneide 2005. (http://sourceforge.net/projects/csound/)) to determine localized frequency fundamentals. The pitch detection algorithm implemented by PVSPITCH is based upon J. F. Schouten's hypothesis that the brain times intervals between the beats of unresolved harmonics of a complex sound in order to find the pitch. The output of PVSPITCH is captured and stored at predetermined intervals (10 ms) and analyzed for pattern correlations. Additionally, the results of PVSPITCH can be directly applied to an oscillator and audibly compared with the original signal.

RMS and Pulse/Beat Tracking (Tempo Extraction)

RMS (root mean square: the statistical measure of the magnitude of a varying quantity) of the input signal is calculated to determine perceived signal strength and then examined for amplitude periodicity via the RMS Csound opcode. While beat/tempo tracking is not currently necessary for the auditory segmentation analysis process, RMS is calculated in attempt to detect changes in event onset and offset data. Csound's TEMPEST opcode has been implemented for beat/tempo extraction. TEMPEST passes auditory input through a lowpass filter and places the residue in a short term memory buffer (attenuated over time) where it is analyzed for periodicity using a form of autocorrelation. The resulting period output is expressed as an estimated tempo (BPM). This result is also used internally to make predictions about future amplitude patterns, which are placed in a buffer adjacent to that of the input. The two adjacent buffers can be periodically displayed, and the predicted values optionally mixed with the incoming signal to simulate expectation.

Timbre/Partial Tracking

The present invention employs a form of Instantaneous Frequency Distribution (IFD) analysis (Toshihiko Abe, Takao Kobayashi, Satoshi Imai, "Harmonics Estimation Based on Instantaneous Frequency and Its Application to Pitch Determination of Speech," IEICE TRANSACTIONS on Information and Systems Vol. E78-D No. 9 pp. 1188-1194, 1995.) originally developed to accomplish spoken language pitch estimation in noisy environments. Implemented via Csound's PVSIFD opcode (Lazzarini, 2005. (http://sourceforge.net/projects/csound/)) which performs an instantaneous frequency magnitude and phase analysis, using the short time Fourier transform (STFT) and IFD. The opcode generates two PV signals—one contains amplitude and frequency data (similar to PVSANAL) while the other contains amplitude and unwrapped phase information.

Stylistic Performance Implications

By further comparing the frequency tracking output with the inferred tempo grid, a generalized stylistic tempo map may optionally be induced. Additionally, it may be useful to compare the placement of note event start points with the inferred tempo grid. Consistent discrepancies likely indicate the presence of a unique style identifier.

Process Flow

Referring now to FIG. 3 there is shown a schematic process flow of the method of the present invention. The method begins by loading a data set representative of music into a computer memory. The method proceeds, as detailed herein, to identify at least one subset of the loaded data set representative of melody, and then to identify at least one subset of the melody data subset that is representative of motive. After such identification, post-processing steps as detailed herein (not shown) may be employed.

Data Representation

Attribute Formatting pitch: MIDI note number (0127)

onset: absolute time offset: absolute time velocity: 0127 (MIDI)

Delta Observations

Input data is represented indirectly within the system of the present invention as a series of change functions which provide pure abstraction of the musical material and ensures context aware analysis. For example: the relationship of three consecutive note events (NEs) (actually, it's the descriptive attributes that are of interest) are represented and compared using two normalized data points that describe the delta change between the NE data.

Adaptive Melodic Segmentation

Calculations Between Consecutive Note Events (NE)

```
pitch, velocity, onset, offset [double]
length (calculated as offset onset) [double]
current_pitch_to_next_pitch [double]
current_length_to_next_length [double]
current_onset_to_next_onset [double]
current_offset_to_next_onset [double]
current_velocity_to_next_velocity [double]
```

Pseudocode:

Set current attribute to next attribute (pitch, onset, length, and velocity) [double]

```
if (NEn > NEn+1)
then {NEn+1 / NEn}
else {NEn / NEn+1}
```

Case Specific Calculations

Pitch Contour is the quality necessary to maintain melodic specificity with regard to the delta pitch attribute.

Property Definitions

```
LSL (long/short/long length profile) [boolean]
pitch_contour (melodic direction) [boolean]
delta_pitch_contour (change of melodic direction) [boolean]
```

Pseudocode: Set Ditch contour [boolean] and delta pitch contour [boolean]

```
if (NEn < NEn+1)
while (NEn++ < NE(n+1)++)
```

-continued

```
then {pitch_contour to NEn+1 = UP}
set delta_pitch_contour found = true
if (NEn > NEn+1)
while (NEn++ > NE(n+1)++)
then {pitch_contour to NEn+1 = DOWN}
set delta_pitch_contour found = true
if (NEn == NEn+1)
while (NEn++ == NE(n+1)++)
then {pitch_contour to NEn+1 = SAME}
set delta_pitch_contour found = true
```

Java Code

```
// Case Specific -- Pitch Contour
NoteEventLystItr previous = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1−1));
// start at beginning−1 of NoteEventLyst
current = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1));//
start at beginning of NoteEventLyst
next = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1+1));
// start at beginning+1 of NoteEventLyst
// scan NoteEvents and set Contour
while (!next.atEnd( )) {
    // Pitch Contour "Up"
    if (!next.atEnd( ) &&
(current.getNoteEvent( ).get_Pitch( ) <
next.getNoteEvent( ).get_Pitch( ))) {
    current.getNoteEvent( ).set_pitch_contour_to_next_note("U");
        assignment_counter++; // keep track of
contour assignments
    }
    // Pitch Contour "Down"
    if (!next.atEnd( ) &&
(current.getNoteEvent( ).get_Pitch( ) >
next.getNoteEvent( ).get_Pitch( ))) {
    current.getNoteEvent( ).set_pitch_contour_to_next_note("D");
        assignment_counter++; // keep track of
contour assignments
    }
    // Pitch Contour "Same"
    if (!next.atEnd( ) &&
(current.getNoteEvent( ).get_Pitch( ) ==
next.getNoteEvent( ).get_Pitch( ))) {
    current.getNoteEvent( ).set_pitch_contour_to_next_note("S");
        assignment_counter++; // keep track of
contour assignments
    }
    previous.advance( );
    next.advance( );
    current.advance( );
}
```

Long Short Long (LSL) Profile assists in identifying segment boundaries.

Property Definitions

LSL (long/short/long length profile) [boolean]

Pseudocode: Set long short long note length (for all NEs) [boolean]

```
if (NEn > NEn+1 < NEn+2)
then {set NEn+2.LSL = true}
```

Java Code

```
// Case Specific -- Long Length
current = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1)); //
start at beginning of NoteEventLyst
next = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1+1));
// start at beginning+1 of NoteEventLyst
NoteEventLystItr twoAhead = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1+2));
// start at beginning+2 of NoteEventLyst
// scan NoteEvents and set LSL
while (!twoAhead.atEnd( )) {
    if ((next.getNoteEvent( ).get__Length( ) >
current.getNoteEvent( ).get__Length( )) &&
(next.getNoteEvent( ).get__Length( ) >
twoAhead.getNoteEvent( ).get__Length( ))) {
    twoAhead.getNoteEvent( ).set__deltalonglength(true);
    }
    next.advance( );
    current.advance( );
    twoAhead.advance( );
}
```

Offset/Onset Overlap accounts for possible NE overlap in offset/onset calculations. (This step is particularly necessary for performance input.)

Pseudocode: Set offset to next onset [double]

```
if (NEn+1.onset < NEn.offset)
then {set offset to next onset = 0} // account for overlap
else {set offset to next onset = NEn+1.onset NEn.
offset}
```

Delta Calculations

Delta values represent amount of change between (NEn, NEn+1) and (NEn+1, Nen+2) and are used to conduct primary data calculations. This represents a significant process advantage in that it allows for the contextually aware attribute layers to align with key identifying characteristics of the original input.

Property Definitions delta_pitch_to_next_pitch [double]

delta_length_to_next_length [double]

delta_onset_to_next_onset [double]

delta_offset_to_next_onset [double]

delta_velocity_to_next_velocity [double]

Pseudocode: Set delta attribute to next attribute (pitch, onset, length, and velocity)

```
set delta = 1 (
abs(NEn NEn+
1))
```

Pseudocode: Set delta offset/onset to next offset/onset [double]

```
if (NEn == 0 or NEn+1 == 0)
then {set delta offset/onset to next offset/onset = 0}
else if (NEn > NEn+1)
then {delta = NEn+1 / NEn}
else {delta = NEn / NEn+1}
```

Java Code

```
// Delta Calculations
NoteEventLystItr current = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1)); //
start at beginning of NoteEventLyst
NoteEventLystItr next = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1+1));
// start at beginning+1 of NoteEventLyst
NoteEventLystItr twoAhead = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1+2));
// start at beginning+2 of NoteEventLyst
while (!next.atEnd( )) {
    // Offset to Onset
    if
((next.getNoteEvent( ).get__current__offset__to__next__onset( ) ==
0 ||
current.getNoteEvent( ).get__current__offset__to__next__onset( ) ==
0)) {
    current.getNoteEvent( ).set__delta__offset__to__next__onset(0.0);
    } else if
(next.getNoteEvent( ).get__current__offset__to__next__onset( ) /
current.getNoteEvent( ).get__current__offset__to__next__onset( ) >=
1) {
    current.getNoteEvent( ).set__delta__offset__to__next__onset((current.-
getNoteEvent( ).get__current__offset__to__next__onset( ) /
next.getNoteEvent( ).get__current__offset__to__next__onset( )));
    } else {
    current.getNoteEvent( ).set__delta__offset__to__next__onset((next.-
getNoteEvent( ).get__current__offset__to__next__onset( ) /
current.getNoteEvent( ).get__current__offset__to__next__onset( )));
    }
    // Onset to Onset
    current.getNoteEvent( ).set__delta__onset__to__next__onset(1 –
(Math.abs(next.getNoteEvent( ).get__current__onset__to__next__onset( ) –
current.getNoteEvent( ).get__current__onset__to__next__onset( ))));
    if (next.current.getNext( ).getNext( ) == null)
{
    current.getNoteEvent( ).set__delta__onset__to__next__onset(0.0);
    }
    // Pitch to Pitch
    current.getNoteEvent( ).set__delta__pitch__to__next__pitch(1 –
(Math.abs(next.getNoteEvent( ).get__current__pitch__to__next__pitch( ) –
current.getNoteEvent( ).get__current__pitch__to__next__pitch( ))));
    if (next.current.getNext( ).getNext( ) == null)
{
    current.getNoteEvent( ).set__delta__pitch__to__next__pitch(0.0);
    }
    // System.out.println("*** Pitch Delta
Calculation Result: " +
current.getNoteEvent( ).get__delta__pitch__to__next__pitch( ));
    // Velocity to Velocity
    current.getNoteEvent( ).set__delta__vel__to__next__vel(1 –
(Math.abs(next.getNoteEvent( ).get__current__vel__to__next__vel( ) –
current.getNoteEvent( ).get__current__vel__to__next__vel
( ))));
    if (next.current.getNext( ).getNext( ) == null)
{
    current.getNoteEvent( ).set__delta__vel__to__next__vel(0.0);
    }
    // Length to Length
    current.getNoteEvent( ).set__delta__length__to__next__length(1 –
(Math.abs(next.getNoteEvent( ).get__current__length__to__next__length( ) –
```

-continued

```
current.getNoteEvent( ).get__current__length__to__next__length( ))));
    if (next.current.getNext( ).getNext( ) == null)
{
    current.getNoteEvent( ).set__delta__length__to__next__length(0.0);
    }
    // Pitch Contour
    if (!twoAhead.atEnd( ) &&
current.getNoteEvent( ).get__pitch__contour__to__next__note( ) ==
"U") {
        if
(next.getNoteEvent( ).get__pitch__contour__to__next__note( ) ==
"U") {
    next.getNoteEvent( ).set__deltapitchcontour(true);
        }
    } else if (!twoAhead.atEnd( ) &&
current.getNoteEvent( ).get__pitch__contour__to__next__note( ) ==
"D") {
        if
(next.getNoteEvent( ).get__pitch__contour__to__next__note( ) ==
"D") {
    next.getNoteEvent( ).set__deltapitchcontour(true);
        }
    } else if (!twoAhead.atEnd( ) &&
current.getNoteEvent( ).get__pitch__contour__to__next__note( ) ==
"S") {
        if
(next.getNoteEvent( ).get__pitch__contour__to__next__note( ) ==
"S") {
    next.getNoteEvent( ).set__deltapitchcontour(true);
        }
    } else {
    next.getNoteEvent( ).set__deltapitchcontour(false);
    }
    assignment__counter++;
    twoAhead.advance( ); current.advance( );
next.advance( );
}
```

Adaptive Thresholds

Threshold Generation is an automatic procedure to establish statistically relevant threshold points for each NE attribute and allow for the creation of boundary candidates. After ensuring the adaptation process begins with a threshold candidate below the lower boundary, this method establishes an appropriate incremental value to be applied to the threshold candidate until the result is within boundary limits. This approach maintains a close link between the threshold and the input data. (NOTE: In extreme cases where the attribute data remains consistently static, the system may be unable to adapt an appropriate threshold. When this happens, the attribute in question does not influence boundary weighing.

Property Definitions

```
pitch__threshold [double]
length__threshold [double]
velocity__threshold [double]
onset__to__onset__threshold [double]
offset__to__onset__threshold [double]
mean = total__delta__change / total__NEs [double]
standard__deviation (using mean) [double]
std__multiplier = 1 [double]
divisor = 1 (pitch, onset, velocity) 100 (length) [int]
divisor__multiplier = 1 (pitch, onset, velocity) 10 (length) [int]
success__multiplier = 4 (pitch, onset, velocity) 2 (length) [int]
increment = (1 mean)/
divisor [double]
lower__boundary = lower bound of acceptable data points (15%) [double]
upper__boundary = upper bound of acceptable data points (45%) [double]
previous__success = number of NEs below the threshold (before
adaptation) [double]
successful__events = number of NEs below the threshold [double]
```

Pseudocode: Set attribute threshold (pitch, onset, length, and velocity) [double]

FIRST PASS ONLY:

set threshold to (std_multiplier*standard_deviation)

test threshold against all NEs if (successful_events>total_NEs*lower_boundary)

then {set std_multiplier=std_multiplier 0.1} else {set threshold to standard_deviation} set threshold to (increment*standard_deviation)

set previous_success to successful_vents test threshold against all NEs (re)set successful_events based on "new" threshold if (successful_events>=previous_success*success_multiplier)

then {set divisor=(successful_events−previous_success)*divisor_multiplier} else (set increment to (1−mean)/divisor)

ALL SUCCESSIVE PASSES (NOT TO EXCEED 1000):

test threshold against all NEs if (successful_events>=total_NEs*lower_boundary &&<=upper_boundary)

then {set threshold to threshold} else if (threshold<1)

{set threshold to threshold+(increment*standard_deviation) and test against all NEs} else {set threshold to null}//unable to determine

Pseudocode: Set offset/onset threshold [double]

set threshold to 0.0175

Max and Min Delta Threshold Change

Having adapted relevant thresholds in the previous stage, this method searches for maximum and minimum results that pass the threshold and stores them.

Property Definitions

```
pitch__max [double]
pitch__min [double]
off__to__on__max [double]
off__to__on__min [double]
on__to__on__max [double]
on__to__on__min [double]
length__max [double]
length__min [double]
vel__max [double]
vel__min [double]
```

Weighting Factors

Attribute thresholds are applied and boundary candidates are identified if their delta value falls below this threshold. A bonus system is employed to produce better (more context aware) decision making. For example, as pitch contour remains constant, equity is accumulated and then spent (as a weighting bonus) when a change is detected. This bonus "equity" is only applied to the result if delta_pitch passes the adaptive threshold value.

Property Definitions

```
pitch__range__percentage = (pitch__max pitch__min)/100 [double]
onset__range__percentage = (on__to__on__max on__to__on__min)/100
[double]
length__range__percentage = (length__max length__min)/100 [double]
deltaattack = false (from onset__to__onset) [boolean]
deltapitch = false [boolean]
deltapitchcontour = false [boolean]
contour__equity = 0 [double]
deltalength = false [boolean]
deltavel = false [boolean]
```

-continued

```
deltalonglength = false [boolean]
store[ ] [array of doubles]
weight_counter = 4 [int]
equity_counter = 0 [int]
booster [double]
weighting (confidence value; 0 = definite, 1 = not boundary) [double]
```

Pseudocode: Apply weighting factor based upon its placement within
delta_threshold range.
FOR ALL NEs:

```
if (NEn.deltapitch = true)
if (pitch_max = pitch_min)
then {store[0] = 1}
else {store[0] = 1 (
NEn1
delta_pitch_change_to_next_pitch pitch_
min) /
(pitch_range_percentage * 0.01)}
if (NEn.deltapitchcontour = true)
if (pitchcontour = UP or DOWN)
then {contour_equity = contour_equity +
(NEn.delta_pitch_to_next_pitch * 0.75)}
if (pitchcontour = SAME)
then {contour_equity = contour_equity + 0.025}
then {store[0] = store[0] * (1 +
(contour_equity / equity_counter)}
then {weight_counter}
else {store[0] = 0}
if (NEn.deltaattack = true)
if (on_to_on_max = on_to_on_min)
then {store[1] = 1}
else {store[1] = 1 (
NEn1
delta_attack_change_to_next_attack attack_
min) /
(attack_range_percentage * 0.01)}
then {weight_counter}
else {store[1] = 0}
if (NEn.deltalength = true)
if (length_max = length_min)
then {store[2] = 1}
else {store[2] = (1 (
NEn1
delta_length_change_to_next_length length_
min) /
(length_range_percentage * 0.01)}
if (NEn.deltalonglength = true)
then {store[2] = store[2] * 1.25}
then {weight_counter}
else {store[2] = 0}
if (NEn.deltaspace = true)
then {booster = booster + 0.75}
if (NEn || NEn1.
delta_offset_to_next_onset = 0 && NEn.deltaattack = true)
then {booster = booster + 0.25}
if (NEn.deltavel = true)
then {booster = booster + 0.15}
if (weight_counter != 0)
then {weighting = 1 (
store[0] / weight_counter + [1] /
weight_counter + [2] / weight_counter) + booster)}
if (weighting < 0)
then {weighting = 0}
```

Java Code

```
public void weightCalculations( ) {
    System.out.println( );
    System.out.println("*** Starting Weight
Calculations");
    for (int vl=1; vl <=
this.getCompleteVoiceLayerLyst( ).size( ); vl++) {
        for (int s=1; s <=
this.getCompleteVoiceLayerLyst( ).get(vl).getValue(
).getCompleteSegmentLyst( ).size( ); s++) {
            // Weight Calculations
            NoteEventLystItr previous = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1)); //
start at beginning of NoteEventLyst
            NoteEventLystItr scanner = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1+1));
// start at beginning+1 of NoteEventLyst
            double totalweight;
            double pitch_range_percentage =
(this.getCompleteVoiceLayerLyst( ).get(vl).getValue
( ).getThresholdPitchMax( ) –
this.getCompleteVoiceLayerLyst( ).get(vl).getValue(
).getThresholdPitchMin( )) / 100;
            double onset_range_percentage =
(this.getCompleteVoiceLayerLyst( ).get(vl).getValue
( ).getThresholdOnToOnMax( ) –
this.getCompleteVoiceLayerLyst( ).get(vl).getValue(
).getThresholdOnToOnMin( )) / 100;
            double length_range_percentage =
(this.getCompleteVoiceLayerLyst( ).get(vl).getValue
( ).getThresholdLengthMax( ) –
this.getCompleteVoiceLayerLyst( ).get(vl).getValue(
).getThresholdLengthMin( )) / 100;
            double[ ] result = new double[3];
            while (!scanner.atEnd( )) {
                result[0] = 0;
                result[1] = 0;
                result[2] = 0;
                totalweight = 1;
                int counter = 4;
                double booster = 0;
                double contour_equity = 0.0;
                int equity_counter = 0;
                if
(scanner.getNoteEvent( ).get_deltapitch( )) {
                    if
(this.getCompleteVoiceLayerLyst( ).get(vl).getValue
( ).getThresholdPitchMax( ) –
this.getCompleteVoiceLayerLyst( ).get(vl).getValue(
).getThresholdPitchMin( ) == 0) {result[0] = 1.0;}
// in case max and min are equal
                    else {
                        result[0] =
previous.getNoteEvent( ).get_delta_pitch_to_next_pitch
( ) –
this.getCompleteVoiceLayerLyst( ).get(vl).getValue(
).getThresholdPitchMin( );
                        result[0] = 1 –
((result[0] / pitch_range_percentage) * 0.01);
                    }
                    if
(scanner.getNoteEvent( ).get_deltapitchcontour( )) {
                        // LEGACY ERROR:
these two "original" lines should not create new
NoteEvents and have been replaced with the
following line (NOV 21st)
                        // NoteEvent
previous_check = new NoteEvent( );
                        // previous_check =
scanner.getValue( ).getPrev( ).getValue( );
                        NoteEventLystItr
previous_check = new
NoteEventLystItr(scanner.getValue( ).getPrev( ));
                        // create new
scanner to check for past contour results
                        NoteEventLystItr
scanner2 = new
NoteEventLystItr(scanner.getValue( ));
    scanner2.deAdvance( );
    scanner2.deAdvance( );
                        // for the first
time through
```

-continued

```
                    if
(scanner2.getNoteEvent( ).get__pitch__contour__to__next
__note( ) == "D" ||
scanner2.getNoteEvent( ).get__pitch__contour__to__next__
note( ) == "U") {
                        contour__equity
= contour__equity +
(scanner2.getNoteEvent( ).get__delta__pitch__to__next__pitch
( ) * 0.5); // reducing average delta value by
1/2 for more reasonable bonus amount
                        //
System.out.println(" Delta Pitch to Pitch is: " +
scanner2.getNoteEvent( ).get__delta__pitch__to__next__pitch
( ));
                        //
System.out.println("    Delta Pitch Change Bonus: "
+ contour__equity);
    equity__counter++;
                    } else {
                        contour__equity
= contour__equity + 0.15; // TODO ORIG = 0.25
                        //
System.out.println("    Same to Same Bonus: " +
contour__equity);
    equity__counter++;
                    }
                    while
(scanner2.getValue( ) !=
this.getCompleteVoiceLayerLyst( ).get(vl).getValue(
).getCompleteSegmentLyst( ).get(s).getValue( ).getSegment
NoteEventLyst( ).get(0) &&
previous__check.getNoteEvent( ).get__pitch__contour__to
__next__note( ) ==
scanner2.getNoteEvent( ).get__pitch__contour__to__next__
note( )) {
                        if
(scanner2.getNoteEvent( ).get__pitch__contour__to__next
__note( ) == "S") {
    contour__equity = contour__equity + 0.15; //
TODO ORIG = 0.25
                        //
System.out.println(" Same to Same Bonus: " +
contour__equity);
    equity__counter++;
                        }
                        if
(scanner2.getNoteEvent( ).get__pitch__contour__to__next
__note( ) == "D" ||
scanner2.getNoteEvent( ).get__pitch__contour__to__next__
note( ) == "U") {
    contour__equity = contour__equity +
(scanner2.getNoteEvent( ).get__delta__pitch__to__next__pitch
( ) * 0.5); // reducing average delta value by
½ for more reasonable bonus amount
                        //
System.out.println(" Delta Pitch to Pitch is: " +
scanner2.getNoteEvent( ).get__delta__pitch__to__next__pitch
( ));
//
System.out.println(" Delta Pitch Change Bonus: "
+ contour__equity);
    equity__counter++;
                        }
    scanner2.deAdvance( );
                    }
                    result[0] =
(result[0] * (1 + (contour__equity /
equity__counter)));
                    //
System.out.println("Equity Counter is: " +
equity__counter);
                    //
System.out.println("Contour Bonus is: " + (1 +
(contour__equity / equity__counter)));
                    contour__equity =
0.0; // reset the contour equity
                }
                counter--;
            }
            else {result[0] = 0;}
```

-continued

```
            if
(scanner.getNoteEvent( ).get__deltaattack( )) {
                if
(this.getCompleteVoiceLayerLyst( ).get(vl).getValue
( ).getThresholdOnToOnMax( ) -
this.getCompleteVoiceLayerLyst( ).get(vl).getValue(
).getThresholdOnToOnMin( ) == 0) {result[1] = 1;}
// in case max and min are equal
                else {
                    result[1] =
previous.getNoteEvent( ).get__delta__onset__to__next__on
set( ) -
this.getCompleteVoiceLayerLyst( ).get(vl).getValue(
).getThresholdOnToOnMin( );
                    result[1] = 1 -
((result[1] / onset__range__percentage) * 0.01) ;
                }
                counter--;
            }
            else {result[1] = 0;}
            if
(scanner.getNoteEvent( ).get__deltalength( )) {
                if
(this.getCompleteVoiceLayerLyst( ).get(vl).getValue
( ).getThresholdLengthMax( ) -
this.getCompleteVoiceLayerLyst( ).get(vl).getValue(
).getThresholdLengthMin( ) == 0) {result[2] = 1;}
// in case max and min are equal
                else {
                    result[2] =
previous.getNoteEvent( ).get__delta__length__to__next__length
( ) -
this.getCompleteVoiceLayerLyst( ).get(vl).getValue(
).getThresholdLengthMin( );
                    result[2] = 1 -
((result[2] / length__range__percentage) * 0.01);
                }
                if
(scanner.getNoteEvent( ).get__deltalonglength( )) {
result[2] = (result[2] * 1.5);        } // TODO ORIG
= 1.25
                counter--;
            }
            else {result[2] = 0;}
            if (counter != 0) {
                if
(scanner.getNoteEvent( ).get__deltavel( )) {booster =
booster + 0.15;}
                if
((scanner.getNoteEvent( ).get__delta__offset__to__next__
onset( ) == 0.0) ||
(scanner.getValue( ).getPrev( ).getValue( ).get__delta
__offset__to__next__onset( ) == 0.0)) {
                    if
(scanner.getNoteEvent( ).get__deltaattack( ))
{booster = booster + 0.25;}
                }
                if
((scanner.getNoteEvent( ).get__deltaspace( )))
{booster = booster + 0.5;} // TODO ORIG = 0.75
                totalweight = 1 -
(((result[0] / counter) + (result[1] / counter) +
(result[2] / counter)) + booster );
                if (totalweight < 0)
{totalweight = 0;}
            }
    scanner.getNoteEvent( ).set__weight(totalweight
);
            scanner.advance( );
            previous.advance( );
        }
        // display the calculation results
        // this.showWeightCalculations(vl,
    s);
    }
}
System.out.println("*** Completed Weight
Calculations");
}
```

Boundary Identification

Examine weighting results (confidence value) and apply a context based adaptive algorithm (using a standard deviation derived threshold) to set definitive boundary points by searching for the lowest (most confident) weightings.

Property Definitions

```
mean = total_weighting / total_NEs
standard_deviation (using mean)
boundary [boolean]
weighting [double]
```

Pseudocode: Define boundaries.

FOR ALL NEs:

```
if NEn+1.weighting <= NEn.weighting
if NEn.weighting < mean (
standard_deviation * 0.80)
then {boundary = true}
```

Java Code

```
public void boundaryOperations( ) {
   System.out.println( );
   System.out.println("*** Starting Boundary
Operations");
   for (int vl=1; vl <=
this.getCompleteVoiceLayerLyst( ).size( ); vl++) {
      for (int s=1; s <=
this.getCompleteVoiceLayerLyst( ).get(vl).getValue(
).getCompleteSegmentLyst( ).size( ); s++) {
         // Boundary Operations
         int counter = 0; // to keep track
of number of Note Events (not 1.0) evaluated
         double total_weight = 0.0;
         int total_counter = 0; // to keep
track of total NEs present
         NoteEventLystItr scanner1 = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1)); //
start at beginning of NoteEventLyst
         scanner1.advance( );
         // necessary to get max/min to
calculate our weighted mean
         while (!scanner1.atEnd( )) {
            total_weight = total_weight +
scanner1.getNoteEvent( ).get_weight( );
            scanner1.advance( );
            total_counter++;
         }
         double[ ] std_array = new
double[total_counter];
         NoteEventLystItr scanner2 = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1)); //
start at beginning of NoteEventLyst
         scanner2.advance( );
         for (int a=0; a < (total_counter);
a++) {
            std_array[a] =
scanner2.getNoteEvent( ).get_weight( );
            scanner2.advance( );
         }
         // calculate weighted mean for
threshold
         double weighted_mean = 0.0;
         weighted_mean =
total_weight/total_counter;
         double std = 0.0;
```

-continued

```
         for (int b=0; b < (total_counter);
b++) {
            double v =
Math.abs(std_array[b] − weighted_mean);
            std = std + (v*v);
         }
         std = (std/total_counter);
         std = Math.sqrt(std);
         /*
          System.out.println("    Total
Weight(" + total_weight + ")/No. Cases(" +
total_counter + ") = Weighted Mean: " +
weighted_mean);
          System.out.println("    Standard
Deviation: " + std);
         */
         double boundary_threshold =
weighted_mean − (std * 0.80); // TODO ORIG =
weighted_mean − (std * 0.80)
   this.complete_voice_layer_lyst.get(vl).getValue
( ).setBoundaryThreshold(boundary_threshold); //
store mastery boundary threshold
         NoteEventLystItr scanner3 = new
NoteEventLystItr(this.getCompleteVoiceLayerLyst( ).
get(vl).getValue( ).getCompleteSegmentLyst( ).get(s)
.getValue( ).getSegmentNoteEventLyst( ).get(1)); //
start at beginning of NoteEventLyst
   scanner3.getNoteEvent( ).set_boundary(true);
// set first note event in piece as a START
boundary
         scanner3.advance( );
         while (!scanner3.atEnd( )) {
            if
(scanner3.getNoteEvent( ).get_weight( ) == 1 &&
!scanner3.atEnd( )) {
               counter++;
               scanner3.advance( );
            }
            else {
               while (!scanner3.atEnd2( )
&&
(scanner3.getValue( ).getNext( ).getValue( ).get_weight
( ) <= scanner3.getNoteEvent( ).get_weight( ))) {
// while we are getting lower weighting value in
each succesive note event
                  counter++;
                  scanner3.advance( );
               }
               if ((counter > 1) &&
(scanner3.current.getValue( ).get_weight( ) <
boundary_threshold)) {
   scanner3.getNoteEvent( ).set_boundary(true);
                  //
scanner3.getValue( ).getNext( ).getValue( ).set_boundary
(true); // !scanner3.atEnd2( )
                  counter = 0;
               }
               else if
(!scanner3.atEnd( )) { // move through LAST events
in piece
                  counter++;
                  scanner3.advance( );
               }
            }
         }
         // display the calculation results
         // this.showBoundaryOperations(vl,
s, boundary_threshold);
      }
   }
   System.out.println("*** Completed Boundary
Operations");
}
public void setSegments( ) {
   System.out.println( );
   System.out.println("*** Creating Segments");
   for (int vl=1; vl <=
this.getCompleteVoiceLayerLyst( ).size( ); vl++) {
      // Set Segments -- build new segments
based on boudary markers
```

-continued

```
        // add each new segment after the
current complete list (starting with 2)
        // this will create a duplicate set of
NEs (312 will become 624)
        // once the operation has been confirmed
(312 did in fact become 624) remove the first
segment
        NoteEventLystItr scanner = new
NoteEventLystItr(this.getCompleteVoiceLayerLyst( ).
get(vl).getValue( ).getCompleteSegmentLyst( ).get(1)
.getValue( ).getSegmentNoteEventLyst( ).get(1)); //
start at beginning of NoteEventLyst (hard coded
for 1 Segment with 1 NoteEventLyst
        int ne_counter = 0;
        while (!scanner.atEnd2( )) {
          if
(scanner.getNoteEvent( ).get_boundary( ) == true) {
              NoteEventLyst NE_LYST = new
NoteEventLyst( ); // create new NoteEventLyst
              // add the initial event
              NoteEvent ne_input =
scanner.getNoteEvent( );
              NE_LYST.addTail(ne_input);
              ne_counter++;
              scanner.advance( ); // advance
scanner to read events within the segment
              // read events within the
segment
              while
(scanner.getNoteEvent( ).get_boundary( ) == false) {
                ne_input =
scanner.getNoteEvent( );
    NE_LYST.addTail(ne_input);
                ne_counter++;
                scanner.advance( );
              }
              // display NE add results
              // System.out.println("
    NE_LYST contains " + NE_LYST.size( ) + " note
events");
              // now stick the NE_LYST into
a new Segment
              Segment SEG_LYST = new
Segment(NE_LYST, false);
    this.getCompleteVoiceLayerLyst( ).get(vl).getValue( ).
getCompleteSegmentLyst( ).addTail(SEG_LYST);
              // System.out.println("
    SEG_LYST contains " +
this.getCompleteVoiceLayerLyst( ).get(vl).getValue(
).getCompleteSegmentLyst( ).size( ) + "
segment(s)");
              // now get the data out
              // System.out.println("    SEG
contains " + SEG_LYSthis.getSegmentSize( ) + " note
event(s)");
          }
        }
        // wrap-up
        // System.out.println( );
        // System.out.println("*** Finalizing
Segment Creation");
        // add the final event to the last
segment
        NoteEvent last_ne =
scanner.getNoteEvent( );
    this.getCompleteVoiceLayerLyst( ).get(vl).getValue
( ).getCompleteSegmentLyst( ).get(this.getComplete
VoiceLayerLyst( ).get(vl).getValue( ).getCompleteSegment
Lyst( ).size( )).getValue( ).getSegmentNoteEvent
Lyst( ).addTail(last_ne);
        ne_counter++;
        // System.out.println(" final NE
added");
        // now get the data out
        // System.out.println(" final SEG now
contains " +
this.getCompleteVoiceLayerLyst( ).get(vl).getValue(
).getCompleteSegmentLyst( ).get(this.getCompleteVoice
LayerLyst( ).get(vl).getValue( ).getCompleteSegment
Lyst( ).size( )).getValue( ).getSegmentNoteEventLyst
( ).size( ) + " note event(s)");
        if (ne_counter !=
this.getCompleteVoiceLayerLyst( ).get(vl).getValue(
).getCompleteSegmentLyst( ).get(1).getValue( ).getSegment
Size( )) {
            // System.out.println("*** Segment
Assignment ERROR Detected: Number of original
events does NOT match the number of assigned
events");
        } else {
            // System.out.println("*** Total of
" + ne_counter + " NEs assigned");
        }
        // remove the first segmment
    this.getCompleteVoiceLayerLyst( ).get(vl).getValue
( ).getCompleteSegmentLyst( ).remove(1);
        // System.out.println(" first segment
removed");
        // final output message
        // System.out.println("*** Number of NEs
in first segment: " +
this.getCompleteVoiceLayerLyst( ).get(vl).getValue(
).getCompleteSegmentLyst( ).get(1).getValue( ).getSegment
Size( ));
        // System.out.println("*** Total of " +
this.getCompleteVoiceLayerLyst( ).get(vl).getValue(
).getCompleteSegmentLyst( ).size( ) + " segments
created (Voice Layer: " + vl + ")");
    }
    System.out.println("*** Completed Creating
Segments");
}
```

Motive Identification

Variation Matrix Processing

This method creates a Euclidean based distance matrix variant that searches for attribute patterns (exact repetition and related variations) while ignoring differences in sample size. The comparison of similar attribute patterns allows the system to determine the extent to which events within identified boundaries share common properties. Rejecting the sample size factor supports variation searches within identified boundaries; a prerequisite for segment ballooning. This "variation matrix" method ("VM") is critical throughout the motive identification process.

Java Code (pitch attribute only)

```
public double Minimum (double a, double b, double
c) {
    double min = a;
    if (b < min) {min = b;}
    if (c < min) {min = c;}
    return min;
}
/********************************* VARIATION MATRIX
**********************************/
public double varMatrix(VoiceLayer vl, Segment s,
Segment t, int type) {
    /* varMatrix Type Key:
    0 = Pitch
    1 = Length
    2 = Onset
     */
    NoteEventLystItr it_source = new
NoteEventLystItr(s.getSegmentNoteEventLyst( ).get(1));
// start at beginning of Segment NoteEventLyst
    NoteEventLystItr it_target = new
NoteEventLystItr(t.getSegmentNoteEventLyst( ).get(1));
// start at beginning of Segment NoteEventLyst
    int SegmentDiff = Math.abs(s.getSegmentSize( )
- t.getSegmentSize( ));
```

-continued

```
        // define arrays to hold candidates segments
        double[ ] sourcearray = new
double[s.getSegmentSize( )];
        double[ ] targetarray = new
double[t.getSegmentSize( )];
        // populate source array
        for (int a=0; a < sourcearray.length; a++) {
                switch (type) {
                case 0: sourcearray[a] =
it_source.getNoteEvent( ).get_delta_pitch_to_next_pitch( );
                break;
                case 1: sourcearray[a] =
it_source.getNoteEvent( ).get_delta_length_to_next_length( );
                break;
                case 2: sourcearray[a] =
it_source.getNoteEvent( ).get_delta_onset_to_next_onset( );
                break;
                }
                it_source.advance( );
        }
        // populate target array
        for (int b=0; b < targetarray.length; b++) {
                switch (type) {
                case 0: targetarray[b] =
it_target.getNoteEvent( ).get_delta_pitch_to_next_pitch( );
                break;
                case 1: targetarray[b] =
it_target.getNoteEvent( ).get_delta_length_to_next_length( );
                break;
                case 2: targetarray[b] =
it_target.getNoteEvent( ).get_delta_onset_to_next_onset( );
                break;
                }
                it_target.advance( );
        }
        double d[ ][ ];
        int i;   // iterates through s
        int j;   // iterates through t
        int n = s.getSegmentSize( );   // length of s
        int m = t.getSegmentSize( );   // length of t
        double s_i;   // ith position of sourcearray
        double t_j;   // jth position of targetarray
        double cost = 0.0;   // cost
        double std = 0.0;   // standard deviation
        double similarity_allowance = 0.0; // for
length and onset
        // initialize the matrix
        d = new double[n+1][m+1];
        for (i = 0; i <= n; i++) {
                d[i][0] = i;
        }
        for (j = 0; j <= m; j++) {
                d[0][j] = j;
        }
        // display temporary results in the terminal
window
        // System.out.println( );
        // System.out.println("Building Variation
Matrix:");
        // System.out.println( );
        if (type == 1) {
                std = vl.getLengthStandardDeviation( );
        }
        if (type == 2) {
                std = vl.getOnsetStandardDeviation( );
        }
        for (i=1; i <= n; i++) {
                s_i = sourcearray[i−1]; // set input
source
                for (j=1; j <= m; j++) {
                        t_j = targetarray[j−1]; // set
input source
                        if (type == 1 || type == 2) {
                                similarity_allowance =
Math.abs((sourcearray[i−1]−targetarray[j−1]));
                        }
                        if ((s_i == t_j) ||
(similarity_allowance < std)) {
                                cost = 0; // if the candidates
are same, there is no cost
                                // System.out.println("Cost
set to 0");
                        }
                        else {
                                // add 1 to actual distance to
get cost
                                cost = 1 +
Math.abs((sourcearray[i−1]−targetarray[j−1]));
                                // System.out.println("Data
subtraction result " + Math.abs((s_i − t_j)));
                                // System.out.println("Cost
set to " + cost);
                        }
                        // find path of least resistance
                        d[i][j] = Minimum (d[i−1][j]+1,
d[i][j−1]+1, d[i−1][j−1] + cost);
                        //d[i][j] = d[i−1][j−1] + cost;
                }
        }
        // display our matrix
        // for (int e=0; e <= n; e++) {
                // for (int f=0; f <= m; f++) {
                        // floor output (display)
                        //
System.out.print((Math.floor(d[e][f] * 1000.000)/
1000.000) + "\t");
                // }
                // System.out.println( );
        // }
        // System.out.println( );
        // System.out.println("Variation Matrix
Output: " + (d[n][m] − SegmentDiff));
        return (d[n][m] − SegmentDiff);
        //return (d[n][m]);
}
public double contourVarMatrix(Segment s, Segment
t) {
        NoteEventLystItr it_source = new
NoteEventLystItr(s.getSegmentNoteEventLyst( ).get(1));
// start at beginning of Segment NoteEventLyst
        NoteEventLystItr it_target = new
NoteEventLystItr(t.getSegmentNoteEventLyst( ).get(1));
// start at beginning of Segment NoteEventLyst
        int SegmentDiff = Math.abs(s.getSegmentSize( )
− t.getSegmentSize( ));
        // define arrays to hold candidates segments
        String[ ] sourcearray = new
String[s.getSegmentSize( )];
        String[ ] targetarray = new
String[t.getSegmentSize( )];
        // populate source array
        for (int i=0; i < sourcearray.length; i++) {
                sourcearray[i] =
it_source.getNoteEvent( ).get_pitch_contour_to_next_note( );
                it_source.advance( );
        }
        // populate target array
        for (int i=0; i < targetarray.length; i++) {
                targetarray[i] =
it_target.getNoteEvent( ).get_pitch_contour_to_next_note( );
                it_target.advance( );
        }
        double d[ ][ ];
        int n;   // length of s
        int m;   // length of t
        int i;   // iterates through s
        int j;   // iterates through t
        String s_i;   // ith position of sourcearray
        String t_j;   // jth position of targetarray
        double cost;   // cost
        n = s.getSegmentSize( );
        m = t.getSegmentSize( );
        // initialize the matrix
        d = new double[n+1][m+1];
        for (i = 0; i <= n; i++) {
                d[i][0] = i;
        }
        for (j = 0; j <= m; j++) {
                d[0][j] = j;
        }
```

-continued

```
        // display temporary results in the terminal
window
        // System.out.println( );
        // System.out.println("Building Variation
Matrix:");
        // System.out.println( );
        for (i = 1; i <= n; i++) {
            s_i = sourcearray[i−1]; // set input
source
            for (j = 1; j <= m; j++) {
                t_j = targetarray[j−1]; // set
input source
                if (s_i == t_j) {
                    cost = 0; // if the candidates
are same, there is no cost
                    // System.out.println("Cost
set to 0");
                }
                else {
                    // add 1 to actual distance to
get cost
                    cost = 1;
                    // System.out.println("Data
subtraction result " + Math.abs((s_i − t_j)));
                    // System.out.println("Cost
set to " + cost);
                }
                // find path of least resistance
                d[i][j] = Minimum (d[i−1][j]+1,
d[i][j−1]+1, d[i−1][j−1] + cost);
                //d[i][j] = d[i−1][j−1] + cost;
            }
        }
        // display our matrix
        for (i = 0; i <= n; i++) {
            for (j = 0; j <= m; j++) {
                // floor output (display)
                //
System.out.print((Math.floor(d[i][j] * 1000.000)/
1000.000) + "\t");
            }
            // System.out.println( );
        }
        // System.out.println( );
        // System.out.println("Variation Matrix
Output: " + (d[n][m] − SegmentDiff));
        return (d[n][m] − SegmentDiff);
        // return (d[n][m]);
    }
```

Similarity Ballooning

Searches current segments for inter-segment attribute uniformity and attempts to combine similar consecutive candidates (based on attribute VM comparisons) to create larger, thematically related sections. (Thematically related sections are defined as multi-segment collections containing variation patterns between neighboring NE delta values.) The goal of similarity ballooning is to reduce the overall number of segments by combining thematically similar units to form the largest possible units of internally related motivic material, thus strengthening system understanding of midlevel musical form.

Segment Similarity

For each segment, determine pitch, pitch contour, and length similarity without regard to sample size.

Property Definitions

```
primary_segment [segment]
secondary_segment [segment]
segment_to_test [segment]
test_target [segment]
voice_layer = current voice layer
```

-continued

```
combine_segments(segment, segment) [segment]
vm_pitch(segment, segment) [double]
vm_contour(segment, segment) [double]
vm_length(segment, segment, voice_layer) [double]
```

Pseudocode: Define segments.

```
test_target = combine_segments (secondary_segment and
segment_to_test)
if (vm_pitch(primary_segment, test_target) < 1.5)
then {if vm_contour(primary_segment, test_target) < 2}
then {if vm_length(primary_segment, test_target, voice_layer) < 0}
then {similarity = true}
else {similarity = false}
```

Java Code

```
public boolean areSegmentsSimilar(VoiceLayer vl,
Segment primary, Segment secondary) {
    VariationMatrix Matrix = new
VariationMatrix( );
    // if segments return PITCH similarity of
less than 1.5
    double pitch_test = Matrix.varMatrix(vl,
primary, secondary, 0);
    if (pitch_test < 1.5) { // was 1.5
        System.out.println("      ***
    Passed Pitch Similarity with: " +
pitch_test);
        // if segments return CONTOUR similarity
of less than 2
        double contour_test =
Matrix.contourVarMatrix(primary, secondary);
        if (contour_test < 2.0) { // was 2.0
        System.out.println("      ***
    Passed Contour Similarity with: " +
contour_test);
            // if segments return LENGTH
similarity of less than 0
            double length_test =
Matrix.varMatrix(vl, primary, secondary, 1);
        if (length_test == 0.0) {
            System.out.println("      ***
    Passed Length Similarity with: " +
length_test);
            return true;
        }
        else {
            System.out.println("      ****
    Failed Length Similarity with: " +
length_test);
        }
    }
    else {
        System.out.println("      ****
    Failed Contour Similarity with: " +
contour_test);
    }
}
else {
    System.out.println("      ****
    Failed Pitch Similarity with: " +
pitch_test);
}
return false;
}
```

Combine Segments

Add the contents of two adjacent segments, returning a single, larger segment.

Property Definitions

```
a_target [segment]
a_target_NE [NE]
b_target [segment]
b_target_NE [NE]
combined_segment [segment]
```

Pseudocode: Combine two adjacent segments.

```
iterate target_a {a_target_NE + combined_segment}
iterate target_b {b_target_NE + combined_segment}
return {combined_segment}
```

Java Code

```
public Segment combineSegments(Segment a, Segment
b) {
    // System.out.println("    ***
    Attempting to Combine Segments");
    // System.out.println("    Segment A contains:
" + a.getSegmentSize( ) + " events");
    // System.out.println("    Segment B contains:
" + b.getSegmentSize( ) + " events");
    // start with new segment
    Segment combine = new Segment( );
    // System.out.println("    Combined Segment
(pre-process) contains: " +
combine.getSegmentSize( ) + " Note Events");
    // prepare to scan through a and b
    NoteEventLystItr a_scanner = new
NoteEventLystItr(a.getSegmentNoteEventLyst( ).get(1));
// start at beginning of Segment NoteEventLyst
    NoteEventLystItr b_scanner = new
NoteEventLystItr(b.getSegmentNoteEventLyst( ).get(1));
// start at beginning of Segment NoteEventLyst
    // System.out.println("    Attempting segment
combination...");
    // start with NEs from segment a
    while (!a_scanner.atEnd( )) {
    combine.getSegmentNoteEventLyst( ).addTail(a_scanner.-
getNoteEvent( ));
        a_scanner.advance( );
    }
    // System.out.println("    Combined Segment (A
only) contains: " + combine.getSegmentSize( ) + "
Note Events");
    // append NEs from segment b
    while (!b_scanner.atEnd( )) {
    combine.getSegmentNoteEventLyst( ).addTail(b_scanner.-
getNoteEvent( ));
        b_scanner.advance( );
    }
    // System.out.println("    Combined Segment
(final) contains: " + combine.getSegmentSize( ) + "
Note Events");
    // System.out.println("    ***
    Combine Segments Complete");
    return combine;
}
```

Large Segment Ballooning

This method compares selected attributes of segments larger than the median segment size for similarity using VM. If candidates pass as similar, the system attempts to "balloon" the smallest candidate by combining it with its smallest neighbor. (NOTE: by first attempting combination using the smaller candidates, the process is made more efficient. If a tie occurs between the neighbors or the candidates themselves, either one may be chosen for initial comparison provided the alternative is immediately considered as well.) VM attribute comparison is once again conducted on the newly ballooned pair. This process is repeated until all candidates have been successfully expanded to their largest potential size while maintaining context-based attribute similarity.

Property Definitions

```
number_of_segments = total number of segments [int]
median_segment_size = median segment size [int]
primary_segment = largest untested segment candidate [segment]
secondary_segment = second largest untested segment candidate
[segment]
current_right_neighbor = right neighbor of current segment candidate
[segment]
current_left_neighbor = left neighbor of current segment candidate
[segment]
balloon_candidate = potential balloon candidate [segment]
Matrix.vm_pitch = VM pitch attribute comparison of primary_segment
and secondary_segment [double]
Matrix.vm_contour = VM pitch contour attribute comparison of
primary_segment and secondary_segment [double]
Matrix.vm_length = VM length (offsetonset)
comparison of primary_segment and secondary_segment [double]
segment_similarity (original_segment, segment_to_test)
combine_segments (a_target, b_target)
```

Pseudocode: Build thematically related sections by combining segments that pass selected attribute VM comparisons.

```
// calculate median segment size
if (number_of_segments%2 == 1) {median_segment_size =
segment_list / 2)}
else {median_segment_size = ((number_of_segments/2)1) +
(number_of_segments/2)) / 2)}
FOR ALL SEGMENTS LARGER THAN median_segment_size:
if (Matrix.vm_pitch < 1.5) and (Matrix.vm_contour < 2) and
(Matrix.vm_length == 0) {
if (primary_segment > secondary_segment) or (primary_segment ==
secondary_segment) {
if (current_left_neighbor > current_right_neighbor) {
balloon_candidate = combine_segments (secondary_segment,
current_right_neighbor)
}
if (current_left_neighbor < current_right_neighbor) {
balloon_candidate = combine_segments (secondary_segment,
current_left_neighbor)
}
segment_similarity (primary_segment, balloon_candidate)
// test the ballooned candidate
if (segment_similarity == true) {update segment_list and rerun method}
if (segment_similarity == false) {rerun method starting with next
largest candidate}
}
if (primary_segment < secondary_segment) {
if (current_left_neighbor > current_right_neighbor) {
balloon_candidate = combine_segments (primary_segment,
current_right_neighbor)
}
if (current_left_neighbor < current_right_neighbor) {
balloon_candidate = combine_segments
(primary_segment, current_left_neighbor)
}
segment_similarity (secondary_segment, balloon_candidate)
// test the ballooned candidate
if (segment_similarity == true) {update segment_list and rerun method}
if (segment_similarity == false) {rerun method starting with next
largest candidate}
}
}
```

Small Segment Ballooning

Same as large segment ballooning however, only candidates smaller than the median segment size are considered.

Split Point Candidates

Tidyup method that searches for uncharacteristically large offset/onset gaps between consecutive NEs within currently defined segment boundaries. As before, this method adapts the required judgment criteria from general data trends. First, standard deviation is calculated based on the inter-quartile mean to provide a statistical measure of central tendency. Gap candidates are then selected if they lie more than 4 standard deviations outside the inter-quartile mean. Once a potential gap candidate has been identified, the method calculates mean-based standard deviation for the NE gaps within the localized segment. If the original candidate lies outside 2 standard deviations of the inter-segment mean, the gap is identified as a split point.

Property Definitions

```
total [double]
iq_mean (interquartile mean) [double]
std (standard deviation using interquartile mean) [double]
calcarray = new
double[get_complete_note_event_list( ).-
get_number_of_note_events( )]
[array of doubles]
event_counter [int]
quartile =
get_complete_note_event_list( ).get_number_of_note_events( )/4.0
[double]
modifier [double]
fractional_low [double]
fractional_high [double]
```

Boundary Split

If split point result occurs with a single NE on either side, the gap isolated NE is removed from the current segment and added to the closest neighbor.

Mid-Segment Split

Otherwise, NE combination adjustments on each side of the split point are tested to find a "best fit" resolution. NEs to the left of the midsegment split are combined with the left neighbor segment and tested against all remaining segments for multiple attribute similarity using the variation matrix method. If no reasonable match is found, the same procedure occurs with NEs to the right of the midsegment split. New segments are created as necessary to accommodate groupings that don't match any of the remaining segments.

Motive and Variation Data Mining

Using a sliding ballooning window data scan method, the system searches within each thematic segment (beginning with the largest) for internal motivic repetition or variation patterns. Repetition and variation is determined using our variation matrix comparison method (pitch and pitch contour attributes). As previously noted, studies in music cognition strongly suggest that beginnings of patterns play a critical role in determining pattern recognition. For this reason, the motive discovery windowing process begins at the start of each thematic segment and slides forward from there.

The motive identification process occurs within individual segments only. This final data mining is successful because it relies heavily upon the robust results achieved by the adaptive segmentation and ballooning processes described above. It is the combination of these two processes (adaptive segmentation and context-aware formal discovery) that allows the windowed scan to reliably identify musically valuable motivic information.

```
pass_counter = 0 [int]
balloon_pass = 0 [int]
primary_window [array of NE attribute values]
target_window [array of NE attribute values]
primary_number_of_events [int]
primary_window_position = 0 [int]
target_window_position = primary_window_position + 3 [int]
```

Pseudocode: Identify motive matches using a ballooning window data scanning technique.

FOR ALL SEGMENTS LARGER THAN 5 (FROM LARGEST TO SMALLEST):

```
for (primary_number_of_events5)
{
primary_window[0] =
pitch_to_next_pitch(NEprimary_window_position)
primary_window[1] =
pitch_to_next_pitch(NEprimary_window_position+1)
if (primary_window[0] ==
primary_window[1]) {primary_window_position++}
else {
target_window[0] =
pitch_to_next_pitch(NEtarget_window_position+pass_counter)
target_window[1] =
pitch_to_next_pitch(NEtarget_window_position+1+pass_counter)
while (primary_window == target_window) {
primary_window[1+balloon_pass] =
pitch_to_next_pitch(NEprimary_window_position+1+balloon_pass)
target_window[1+balloon_pass] =
pitch_to_next_pitch(NEtarget_window_position+1+pass_counter+
balloon_pass)
balloon_pass++
}
if (balloon_pass > 0 ) {return motive}
}
primary_window_position++
reset balloon_pass
}
```

Java Code

```
double d[ ][ ];
int n = 2; // size of source window (delta values)
int m = 2; // size of target window (delta values)
double current_comparison = 0.0;
double previous_comparison = 0.0;
// define arrays to hold candidates segments
double[ ] sourcearray = new double[n];
double[ ] targetarray = new double[m];
int match_count = 0;
boolean primary_comparison_same = false;
for (int i = 1; i < s.get_number_of_segments( )+1;
i++) { // control segment advancement
segment primary = s.indexreturn(i1).
getData( );
int pass = 0; // count number of passes
for (int a = 0; a <
(s.get_segment_at_index(i).get_number_of_note_events( )5);
a++) { // control window slide advancement
match_count = 0; // reset the match counter
// only consider segments with more than 5 NEs
if
((s.get_segment_at_index(i).-
get_number_of_note_events( ) > 5) && (pass+1 <
s.get_segment_at_index(i).get_number_of_note_events( ))) {
for (int p = 0; p < n; p++) {
sourcearray[p] =
primary.get_segment_note_events_list( ).indexreturn
(p+pass).getData( ).get_current_pitch_to_next_pitch( );
}
previous_comparison = 0.0; // reset the previous
comparison data
```

-continued

```
for (int r = 0; r < n; r++) {
current__comparison = sourcearray[r]; // check
primary array for duplication at the beginning
(repeated notes/changes)
if (current__comparison == previous__comparison)
{primary__comparison__same = true;}
previous__comparison = current__comparison; //
update current comparison
System.out.print("NE" + (r+pass+1) + ""
+ (r+pass+2) + ": ");
System.out.print(sourcearray[r] + ", ");
}
if (primary__comparison__same == true)
{System.out.println("Primary values are the same
skipping analysis");}
else {System.out.println("Primary values are the
different continuing analysis");}
int round = 0;
// check that we don't search beyond the segment
end, and that the source data isn't the same
while ((round+pass <
s.get__segment__at__index(i).get__number__of__note__events( )5)
&& (primary__comparison__same == false)) {
targetarray[0] =
primary.get__segment__note__events__list( ).indexreturn
(3+round+pass).getData( ).get__current__pitch__to__next__pitch( );
targetarray[1] =
primary.get__segment__note__events__list( ).indexreturn
(4+round+pass).getData( ).get__current__pitch__to__next__pitch( );
// local implementation of Variation Matrix
int k; // iterates through s
int j; // iterates through t
double s__k; // ith position of sourcearray
double t__j; // jth position of targetarray
double cost; // cost
d = new double[n+1][m+1];
for (k = 0; k <= n; k++) {d[k][0] = k;}
for (j = 0; j <= m; j++) {d[0][j] = j;}
for (k = 1; k <= n; k++) {
s__k = sourcearray[k1];
// set the input source
for (j = 1; j <= m; j++) {
t__j = targetarray[j1];
// set the input source
if (s__k == t__j) {cost = 0; // if the candidates
are the same, then there is no cost}
else {cost = 1 + Math.abs((sourcearray[k1]
targetarray[j1]));}
// find the path of least resistance
d[k][j] = Minimum (d[k1][j]+1, d[k][j1]+
1, d[k1][j1]
+ cost);
}
}
int SegmentDiff = Math.abs(nm);
// balloon the candidates if exact match is found
if (d[n][m] SegmentDiff
== 0.0) {
int balloon__pass = 1;
boolean balloon__continue = true;
double[ ] balloon__source__array = new
double[s.get__segment__at__index(i).get__number__of__note__events( )];
double[ ] balloon__target__array = new
double[s.get__segment__at__index(i).get__number__of__note__events( )];
while (balloon__continue == true) { // master
ballooning control
balloon__source__array[0] = sourcearray[0];
balloon__source__array[1] = sourcearray[1];
balloon__target__array[0] = targetarray[0];
balloon__target__array[1] = targetarray[1];
if ((4+round+pass+2+balloon__pass) <=
s.get__segment__at__index(i).get__number__of__note__events( ) &&
(balloon__pass+pass+3) <
(4+round+pass+1+balloon__pass)) { // check for end
of segment and primary collision with target
balloon__source__array[1+balloon__pass] =
primary.get__segment__note__events__list( ).indexreturn
(1+pass+balloon__pass).
getData( ).get__current__pitch__to__next__pitch( );
balloon__target__array[1+balloon__pass] =
primary.get__segment__note__events__list( ).indexreturn
(4+round+pass+balloon__pass).
getData( ).get__current__pitch__to__next__pitch( );
// be sure last two target candidates are not same
as the first two primary candidates
if ((balloon__target__array[(1+m+balloon__pass)2]
!= balloon__source__array[0]) &&
(balloon__target__array[(1+m+balloon__pass)1]
!= balloon__source__array[1])) {
// run local match test
d = new
double[n+1+balloon__pass][m+1+balloon__pass];
for (k = 0; k <= n+balloon__pass; k++) {d[k][0] =
k;}
for (j = 0; j <= m+balloon__pass; j++) {d[0][j] =
j;}
for (k = 1; k <= n+balloon__pass; k++) {
s__k = balloon__source__array[k1];
// set the input source
for (j = 1; j <= m+balloon__pass; j++) {
t__j = balloon__target__array[j1];
// set the input source
if (s__k == t__j) {cost = 0; // if the candidates
are the same, then there is no cost}
else {cost = 1 +
Math.abs((balloon__source__array[k1]
balloon__target__array[j1]));}
// find the path of least resistance
d[k][j] = Minimum (d[k1][j]+1, d[k][j1]+
1, d[k1][j1]
+ cost);
}
}
SegmentDiff = Math.abs((n+balloon__pass)(
m+balloon__pass));
if (d[n+balloon__pass][m+balloon__pass] SegmentDiff
== 0.0) {
System.out.println(" Ballooning Successful!");
match__count++;
balloon__continue = true;
} else {
System.out.println(" Ballooning Aborted Candidates
to not match");
//primary__starting__position = 0;
balloon__continue = false;
}
} else {
System.out.println(" Ballooning Aborted Repeat
of Motive Detected");
//primary__starting__position = 0;
balloon__continue = false;
}
} else {
System.out.println(" Ballooning Aborted End
of Segment or Segment Collision Detected");
//primary__starting__position = 0;
balloon__continue = false;
} // end of nested match ballooning (nested for
data check)
balloon__pass++;
}
}
round++;
}
} else if
(s.get__segment__at__index(i).get__number__of__note__events( ) < 5 ) {
System.out.println(" Contains " +
s.get__segment__at__index(i).get__number__of__note__events( ) +
" note events skipping analysis");
} else {
System.out.println(" End of Segment Detected");
}
System.out.println(match__count + " matches
found!");
primary__comparison__same = false; // reset the
primary comparison value
pass++;
}
}
```

Discovered motivic patterns can be stored and compared against the remaining candidates to determine its prototypical form and made available for further application specific processing.

Optional Operation Post-Processing

For certain post-processing applications, it may be necessary for model data to exist in two forms:

1) Style Tagged: Data initially provided to the system is tagged with a predetermined style association for purposes of categorization and software training. This approach is similar to the way humans acquire and process novel information; or
2) Analysis-Based Classification: Groupings are inferred once the appropriate amount of input data is present. Algorithms parse the data looking for relationships between the various input streams and identify relevant connections. The result expands and enhances the useful style repertoire and maintains an approach similar to human-based induction.

Auditory Specific Processing

The frequency analysis process is to be tested on exposed (separated) audio layers with the aim of detecting pitch and timber changes relative to a known tempo/beat grid.

Median Filters

Nonlinear digital filtering used to remove noise from the input data stream. Results are stored for further analysis.

Frequency Analysis

Median Filters are applied to the Frequency Tracking output at predetermined intervals (for example, 50 ms) to search for areas where the analysis results are within a range of 70 cents (0.7 semitones). (NOTE: In terms of octave point decimal notation, one semitone is a difference of 0.08333 . . . )

Timbre Analysis

IFD is applied to detect the presence of specific partials. Predefined bands check for changes in harmonic content over time and determine when significant change has occurred. Results are provided as an indicator value and stored for further stylistic analysis.

Segment Function Assignment

Function analysis may be used to build larger phrase-based musical forms based on previously analyzed models. Initially these models are added as manual input, but eventually become integral to the system's comparative reading of the analysis data.

Function Analysis

Vertical and approach interval tensions are combined with representations of duration and metric emphasis. Measurable units are applied to these attributes in order to allow for analysis computation. Phrases may be defined and a grouping average determined.

Automated Style Classification

Additional classification relationships are identified once the necessary data is present. This approach expands system applications by suggestion musically appropriate substitutions when alternative solutions are desired. This discovered relationship demonstrates resonance between the input data and the inductive association necessary to create connections.

Context Development

When possible, auditory and manual analysis and classification data are combined to create a comprehensive picture of musical style characteristics.

INDUSTRIAL APPLICATION

One application of the system and method disclosed herein is in the quantification of substantial similarity between or among a plurality of musical data sets. Such quantification would be useful in judicial proceedings where copyright infringement is alleged, and there exists a need for testimony regarding the similarities between the accused musical work or performance and one or more of the plaintiff's musical works and/or performances. Heretofore, expert musicologists have provided expert testimony based on artistic qualitative measures of similarity. Using the method and system of the present invention, however, will permit quantitative demonstrations of similarities in a wide range of characteristics of the music, allowing a high degree of certainty about copying, influence, and the like.

While the invention has been described in its preferred embodiments, it is to be understood that the words which have been used are words of description rather than of limitation and that changes may be made within the purview of the appended claims without departing from the true scope and spirit of the invention in its broader aspects. Rather, various modifications may be made in the details within the scope and range of equivalents of the claims and without departing from the spirit of the invention. The inventor further requires that the scope accorded his claims be in accordance with the broadest possible construction available under the law as it exists on the date of filing hereof (and of the application from which this application obtains priority,) and that no narrowing of the scope of the appended claims be allowed due to subsequent changes in procedure, regulation or law, as such a narrowing would constitute an ex post facto adjudication, and a taking without due process or just compensation.

I claim:

1. A computer program product, comprising a machine-readable storage medium having a computer readable program code embodied therein, said computer readable program code adapted to be executed to implement a method for characterizing a data set representative of music, the method comprising:

a. inputting a data set representative of music into the machine-readable storage medium;
b. processing the data set so as to identify within the data set at least one subset of data representing melody; and
c. processing the at least one subset of data representing melody so as to identify within said subset of data representing melody at least one subset of data representing at least one motive.

2. The method of claim 1 wherein the data set representative of music comprises encoded digital audio.

3. The method of claim 1 wherein the data set representative of music comprises encoded performance information.

4. The method of claim 3 wherein the data set representative of music includes encoded digital audio.

5. The method of claim 1 wherein the data set representative of music comprises information representative of one or more of the following characteristics: phrase structure, measure information, tempo information, section identifiers, stylistic attributes, exact pitch, onset, offset, velocity, and note density.

6. The method of claim 1 wherein the motive is identified using adaptive melodic segmentation.

7. The method of claim 1 wherein said processing the data set comprises:

a. identifying note events within the data set;
b. determining at least one attribute for each note event, the attributes being selected from among pitch, onset, length and velocity; and
c. determining the attributes of difference between consecutive note events.

8. The method of claim 7 wherein the step of identifying note events is preceded by at least one preprocessing step selected from the group of: equal loudness contour filtering, spectral pitch tracking, tempo extraction, instantaneous frequency distribution analysis, and style identification.

9. The method of claim 7 wherein the step of identify the subset of data representing melody additionally comprises:

a. determining pitch contour between each note event pair and determining note length for each note event.

10. The method of claim 9 further comprising the step of segmenting the subset of data representing melody into motive segments.

11. The method of claim 10 wherein the segmentation is performed by a method comprising:

a. defining thresholds of change of the attributes or contours;

b. weighting the defined thresholds; and c. determining boundaries within the subset of data representing melody;

d. identifying motive segments between the boundaries.

12. The method of claim 11 wherein consecutive motive segments are combined into a single, larger motive segment by similarity ballooning.

13. A computer-implemented system for characterizing a data set representative of music comprising:

a. means for identifying within the data set at least one subset of data representing melody; and b. means for identifying within said subset of data representing melody at least one subset of data representing at least one motive.

14. A computer program product, comprising a machine-readable storage medium having a computer readable program code embodied therein, said computer readable program code adapted to be executed to implement a method for quantitatively assessing the similarities between or among a plurality of data sets representative of music wherein one or more accused data sets represents an alleged infringement of copyright in one or more proprietary data sets, the method comprising:

a. inputting the data sets into the machine-readable storage medium;

b. Processing each of the data sets to identify the motives therein by adaptive melodic segmentation; and c. Comparing the motives identified to establish the degree of similarity between or among the data sets.

15. A method for developing a prototypical motive within a piece of music comprising:

providing a readable storage medium containing a first set of data representative of performance data of the piece of music and a second set of data representative of auditory information of the piece of music;

analyzing the first and second data sets to identify a plurality of note attributes of a plurality of note events of the piece of music;

determining at least one melody based on at least one of the plurality of note attributes; and developing a prototypical motive based, at least in part, from the plurality of note attributes, wherein the prototypical motive is a subset of the at least one melody.

16. A method according to claim 15, wherein said analyzing is conducted via adaptive melodic segmentation.

17. A method according to claim 16, wherein adaptive melodic segmentation includes:

determining threshold candidates from the plurality of note attributes;

grouping a plurality of note events existing between threshold candidates into potential melodies; and analyzing the potential melodies for opportunities to combine one or more of the potential melodies based upon similarities in note attributes of the plurality of note events within each of the potential melodies.

18. A method for developing a prototypical motive within a piece of music comprising:

storing a piece of music in both performance and auditory forms;

generating a plurality of note attributes from a plurality of note events in the performance form and from a corresponding plurality of note events in the auditory form;

determining at least one melody based upon at least one of said plurality of note attributes;

extracting at least two motives from the at least one melody; and comparing one of the least two motives with the other of the at least two motives to determine a prototypical motive for the piece of music.

* * * * *